US011453516B2

(12) United States Patent
Kooc et al.

(10) Patent No.: US 11,453,516 B2
(45) Date of Patent: Sep. 27, 2022

(54) APPLICATOR PLATE, APPARATUS AND METHOD

(71) Applicant: WestRock Packaging Systems, LLC, Atlanta, GA (US)

(72) Inventors: Linh L. Kooc, Richmond, VA (US); Casey P. Grey, Richmond, VA (US); Matthew E. Zacherle, Chesterfield, VA (US)

(73) Assignee: WESTROCK PACKAGING SYSTEM, LLC, Atlanta, GA (US)

( * ) Notice: Subject to any disclaimer, the term of this patent is extended or adjusted under 35 U.S.C. 154(b) by 183 days.

(21) Appl. No.: 16/332,024

(22) PCT Filed: Sep. 29, 2017

(86) PCT No.: PCT/US2017/054275

§ 371 (c)(1),
(2) Date: Mar. 11, 2019

(87) PCT Pub. No.: WO2018/049429

PCT Pub. Date: Mar. 15, 2018

(65) Prior Publication Data

US 2019/0233145 A1 Aug. 1, 2019

Related U.S. Application Data

(60) Provisional application No. 62/393,344, filed on Sep. 12, 2016.

(51) Int. Cl.

| | |
|---|---|
| ***B65B 17/02*** | (2006.01) |
| ***B65B 5/06*** | (2006.01) |
| *B65B 27/04* | (2006.01) |

(52) U.S. Cl.
CPC ..... *B65B 17/025* (2013.01); *B65B 27/04* (2013.01)

(58) Field of Classification Search
CPC ..... B65D 71/50; B65B 27/04; B65B 17/025; B65B 5/06
USPC ... 53/48.1, 48.6, 48.8, 48.9, 398, 48.3, 48.5, 53/48.4, 410
See application file for complete search history.

(56) References Cited

U.S. PATENT DOCUMENTS

| | | | | |
|---|---|---|---|---|
| 1,367,069 A * | 2/1921 | MacKinnon | B65D 85/305 217/21 |
| 2,929,181 A | 3/1960 | Poupitch | |
| 2,993,621 A * | 7/1961 | Mummaharold | B65B 43/44 221/210 |
| 3,070,928 A * | 1/1963 | Ganz | B65B 21/24 53/48.7 |

(Continued)

FOREIGN PATENT DOCUMENTS

| | | |
|---|---|---|
| EP | 1075219 B1 | 10/2003 |
| GB | 1427510 | 3/1976 |

(Continued)

*Primary Examiner* — Gloria R Weeks
(74) *Attorney, Agent, or Firm* — Neil G. Cohen; Brian J. Goldberg

(57) ABSTRACT

Aspects of the invention relate to an applicator plate (10) for use in an apparatus (80) for attaching a set of frangibly adjoined top engaging clips (110) to a group of articles 'C'. The applicator plate (10) having a generally planar body; and a plurality of apertures (16*a*-26*f*) within the body. Each aperture (16*a*-26*f*) has a series of internal walls (16*i*-16*x*) arranged such that each aperture (16*a*-26*f*) has a polygonal shape.

13 Claims, 10 Drawing Sheets

(56) References Cited

U.S. PATENT DOCUMENTS 3,137,109 A 6/1964 Rapata
3,147,738 A * 9/1964 Theilig ..... A01K 41/065 119/322
3,242,631 A 3/1966 Whiteford
3,302,364 A * 2/1967 Rice ..... B65B 17/025 53/398
3,515,272 A 6/1970 Von Gal
3,664,497 A 5/1972 Mascia
3,817,215 A * 6/1974 Levin ..... A01K 41/065 119/322
3,867,807 A * 2/1975 Doucette ..... B65B 17/025 53/48.1
3,974,658 A * 8/1976 Starrett ..... B65D 25/02 62/60
4,037,722 A * 7/1977 Bremer ..... B65D 81/113 206/523
4,263,767 A * 4/1981 Kyle ..... B65B 31/021 53/51
4,392,337 A * 7/1983 Hara ..... B65B 17/025 53/48.4
4,505,089 A * 3/1985 Osteen ..... B65B 17/025 53/48.5
4,506,495 A * 3/1985 Romagnoli ..... B29C 51/30 53/559
4,518,081 A 5/1985 de Larosiere
4,606,454 A * 8/1986 Hambleton ..... B65D 71/10 206/147
4,641,483 A * 2/1987 Yamauchi ..... B65B 17/025 53/390
4,911,300 A * 3/1990 Colonna ..... B65D 71/50 206/427
5,016,761 A * 5/1991 Stoddard ..... A47F 3/14 108/55.1
5,088,269 A * 2/1992 Thelen ..... B65B 17/025 53/398
5,125,506 A 6/1992 Glabierz et al.
D333,093 S * 2/1993 Rehrig ..... D9/456
5,188,225 A * 2/1993 Jorba ..... B65D 71/46 206/145
5,221,002 A * 6/1993 Garganese ..... B65D 71/50 294/169
5,237,796 A 8/1993 Bonkowski
5,263,299 A 11/1993 Galbierz et al.
5,377,862 A * 1/1995 Oakes ..... B65D 71/70 206/433
5,503,267 A * 4/1996 Sutherland ..... B65D 71/48 206/148
5,551,566 A 9/1996 Sutherland
5,553,705 A * 9/1996 Bakx ..... B65D 71/40 206/158
5,711,419 A * 1/1998 Beales ..... B65D 71/40 206/147
5,791,121 A * 8/1998 Bernier ..... B65B 17/025 53/390
5,845,776 A * 12/1998 Galbierz ..... B65D 71/48 206/427
5,884,757 A * 3/1999 Prince ..... B65D 71/50 206/153
6,039,181 A * 3/2000 Whiteside ..... B65D 71/125 206/427
6,076,331 A * 6/2000 Granbakken ..... B65D 71/42 53/398
6,112,497 A * 9/2000 Credle, Jr. ..... G07F 11/10 53/168
6,170,225 B1 * 1/2001 Cervantes ..... B65B 61/06 53/48.4
6,336,309 B1 * 1/2002 Groppi ..... B65B 17/025 53/484
6,367,645 B1 * 4/2002 Trygg ..... B65D 21/0231 220/513
6,394,272 B1 * 5/2002 Domansky ..... B65D 71/246 206/151
6,508,047 B1 * 1/2003 Groppi ..... B65B 17/025 53/432
6,625,960 B1 * 9/2003 Nambu ..... B65B 23/06 198/523
6,658,815 B1 12/2003 Gaspar
6,702,115 B1 * 3/2004 Roper ..... B65D 5/5061 206/427
7,017,746 B2 * 3/2006 Apps ..... B65D 1/243 206/509
7,661,527 B2 * 2/2010 Cerf ..... B65D 71/10 206/432
8,056,709 B2 * 11/2011 Sutherland ..... B65D 71/46 206/148
8,100,273 B2 * 1/2012 Apps ..... B65D 19/44 211/74
8,112,970 B2 * 2/2012 Marco ..... B65B 21/24 53/398
8,448,411 B2 * 5/2013 Huber ..... B65B 35/44 53/398
9,114,566 B2 * 8/2015 Shanley, IV ..... B29C 51/00
9,815,605 B2 * 11/2017 Bates ..... B65D 71/504
10,358,239 B2 * 7/2019 Daniel ..... B65B 35/44
D881,718 S * 4/2020 Bandinu ..... D9/755
10,836,550 B2 * 11/2020 Zacherle ..... B65D 71/42
10,913,560 B2 * 2/2021 Ludwig ..... B65B 67/00
2002/0195371 A1 * 12/2002 Brown ..... A47G 23/0641 206/564
2005/0133386 A1 * 6/2005 Wong ..... B65D 71/50 206/139
2007/0193889 A1 8/2007 Olsen et al.
2008/0194017 A1 * 8/2008 Esser ..... C12M 23/12 435/307.1
2009/0127147 A1 * 5/2009 Sutherland ..... B65D 71/42 206/429
2015/0197357 A1 * 7/2015 Ludwig ..... B65B 27/04 53/398
2018/0362234 A1 * 12/2018 L'Heureux ..... B65B 61/182
2021/0261279 A1 * 8/2021 Zacherle ..... B65B 35/30

FOREIGN PATENT DOCUMENTS

WO WO93/21093 10/1993
WO WO97/18993 5/1997

* cited by examiner

APPLICATOR PLATE, APPARATUS AND METHOD

CROSS-REFERENCE TO RELATED APPLICATIONS

This application is a National Phase application of PCT Application PCT/US17/54275, filed Sep. 29, 2017, which claims the benefit of U.S. Provisional Patent Application No. 62/393,344, filed Sep. 12, 2016, which is incorporated herein by reference in its entirety.

FIELD OF THE INVENTION

The present invention relates to an applicator plate for use in an apparatus for attaching one or more clips to a group of articles and more specifically, but not exclusively to an applicator plate comprising a plurality of apertures each having a series of internal walls arranged such that each aperture has a polygonal shape for forming the one or more clips to the group of articles. Even more specifically, but not exclusively, the present invention relates to an applicator plate for attaching a set of frangibly adjoined clips to a group of articles, the applicator plate arranged such that the frangible connection between adjoined clips is broken to form a series of separate clips and separate groups of articles. Furthermore, the invention relates to an apparatus comprising the applicator plate and to a method of forming groups of articles.

BACKGROUND OF THE INVENTION

In the field of packaging it is often required to provide consumers with a package comprising multiple primary product containers. The primary product containers may be held together by a top engaging carrier such that a group of articles can be selected and transported as a single unit. One such top engaging carrier is formed from plastic and comprises a series of linked rings. The rings fit over the rimmed edges of cans and groups of cans can be held together using such plastic rings. Disadvantages of such plastic rings are that the plastic cannot easily be printed on in order to provide additional marketing, branding and promotional indicia; the plastic is not readily recyclable; and the plastic rings have been associated with health risks to wildlife.

In order to provide an improvement in this field, the present applicant has invented a new top engaging clip for grouped articles (which is the subject of a separate patent application) and an apparatus suitable for attaching the new top engaging carrier.

SUMMARY OF INVENTION

According to a first aspect there is provided an applicator plate for use in an apparatus for attaching one or more top engaging clips to a group of articles. The applicator plate having: a generally planar body; and a plurality of apertures within the body, wherein each aperture has a series of internal walls arranged such that each aperture of said plurality of apertures has a polygonal shape.

Optionally, an upper surface of said generally planar body is flat.

Optionally, each aperture has ten internal walls arranged such that the aperture has a decagon shape.

Optionally, the applicator plate further comprises at least one peg depending from a lower surface of said generally planar body.

Optionally, the plurality of apertures are arranged in a matrix of rows and columns wherein said at least one peg depends from a location to the end or side of the matrix of apertures.

Optionally, the at least one peg has a flat base and two side walls, wherein the two side walls meet at a first end of the peg, wherein the two side walls meet at a second end of the peg, wherein between the first and second ends the two side walls each curve outwardly away from the first and second ends, and wherein the peg has a substantially leaf-shaped cross-section.

Optionally, the plurality of apertures comprises twenty-four apertures arranged in four columns and six rows.

Optionally, the at least one peg comprises fourteen pegs, two pegs at each end of the four columns and five pegs at each side of the six rows.

Optionally, each peg is positioned adjacent to two apertures of the matrix.

Optionally, the applicator plate comprises a series of apertures or recesses through which an alignment peg, of an apparatus with which the applicator plate is used, may pass.

According to another aspect, there is provided an apparatus for attaching a set of frangibly adjoined top engaging clips to a group of articles, the apparatus comprising:

(i) an applicator plate according to any of the relevant preceding paragraphs;
(ii) a base plate for receiving a group of articles; and
(iii) a reciprocating element coupled to the applicator plate and/or base plate and being operable to provide relative movement of the applicator plate and base plate toward one another and away from one another.

Optionally, the apparatus comprises a top plate coupled to the reciprocating element, wherein the reciprocating element is operable to move the top plate towards the base plate.

Optionally, the applicator plate is associated with the top plate and moves towards the base plate with the top plate.

Optionally, the applicator plate is structured and arranged to locate and form a set of frangibly adjoined top engaging clips onto a group of articles positioned on the base plate and is structured and arranged to break the frangible connection between adjoined engaging clips of the set in order to form a discrete number of clipped together groups of articles.

Optionally, a grouping component is provided and is structured and arranged for receiving a group of articles and for maintaining the group of articles as an organized group.

Optionally, the grouping component comprises four sides, a base and an open top and wherein a group of cans can be deposited on said base and retained by the four side walls.

Optionally, the reciprocating element comprises a handle, lever arm and coil spring coupled together such that depression of the handle causes the spring to contract which causes the applicator plate to be lifted up away from the grouping component.

Optionally, the apparatus further comprises a drive means for moving the reciprocating element up and down.

Optionally, the applicator plate is releasably attachable to the apparatus.

Optionally, the applicator plate is releasably attachable to the top plate.

Optionally, the top plate comprises at least one alignment peg.

According to yet a further aspect, there is provided a method of attaching one or more top engaging clips to a group of articles, the method comprising:

(i) receiving a group of articles and maintaining the group of articles as an organized group;

(ii) providing an applicator plate according to any of the relevant preceding paragraphs; and (iv) locating and forming the one or more clips onto the group of articles thereby forming one or more clipped together groups of articles.

Optionally, the one or more top engaging clips comprises a set of frangibly adjoined top engaging clips and the step of locating and forming the set of frangibly adjoined top engaging clips breaks the frangible connection between adjoined top engaging clips of the set and thereby forms a discrete number of clipped together groups of articles.

Optionally, the method further comprises:

(i) associating the set of frangibly adjoined top engaging clips with a lower surface of the applicator plate; and (ii) moving the applicator plate and set of frangibly adjoined top engaging clips down towards the group of articles Within the scope of this application it is envisaged that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION OF EMBODIMENTS OF THE PRESENT INVENTION

Detailed descriptions of specific embodiments of the applicator plates, apparatus and methods are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the applicator plates, apparatus and methods described herein may be embodied in various and alternative forms. The figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 3:
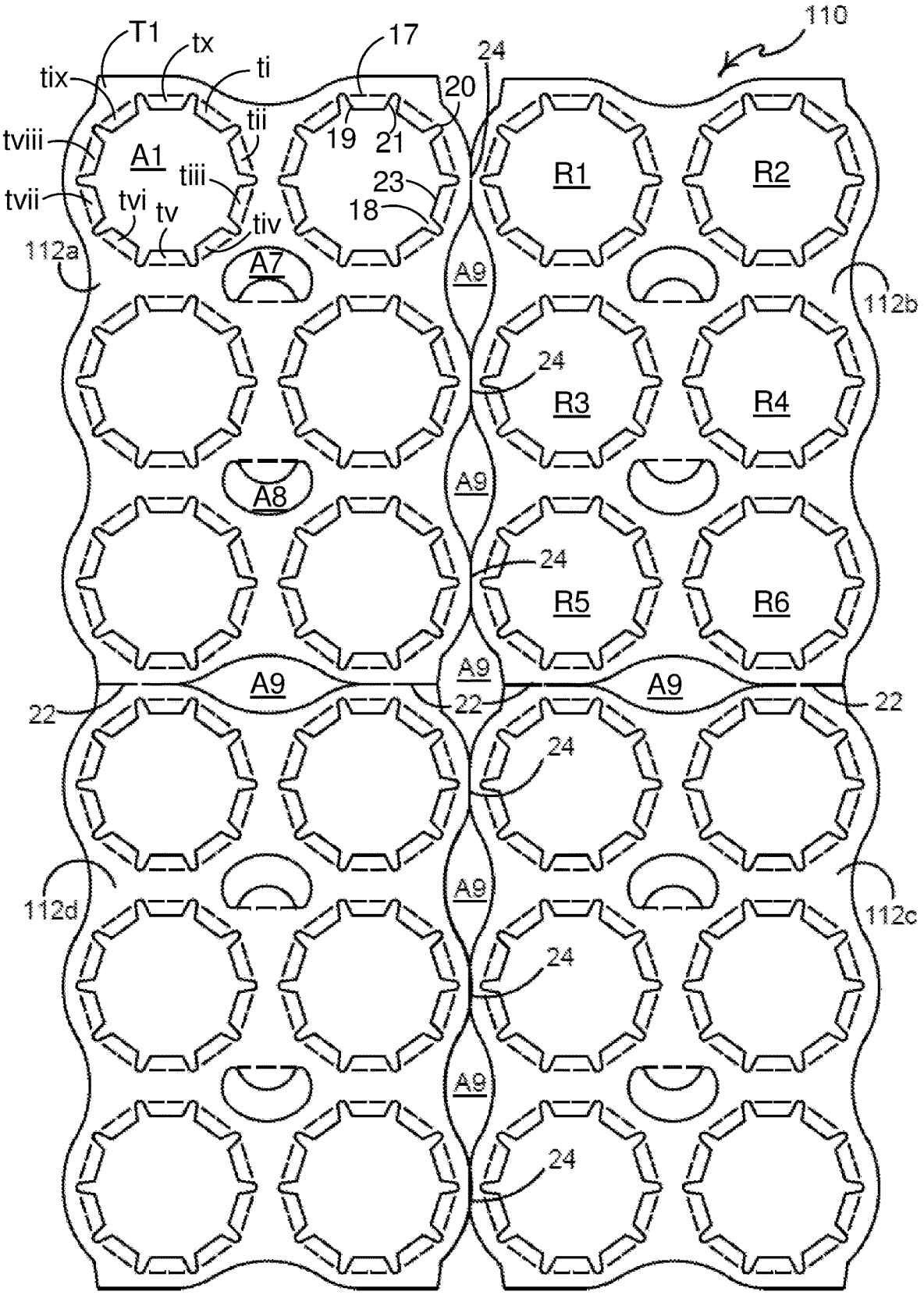
FIG. 3 is a plan view from above of a set of adjoined top engaging clips, each top engaging clip of the set for attaching an array of articles together in a group, for example a 2×3 arrangement of cans in a single group.

Referring to FIG. 3 there is shown a plan view from above of a blank 110 that forms a set of top engaging clips 112*a*, 112*b*, 112*c*, 112*d* frangibly adjoined by frangible connections 22, 24. The blank 110 is to be attached as a single unit to a grouped arrangement of articles 88 (see FIGS. 4, 5, 6A, 6B for example). Each top engaging clip 112*a*, 112*b*, 112*c*, 112*d* of the set is to be attached to an optional 2×3 arrangement of articles and separated from the other top engaging clips 112*a*, 112*b*, 112*c*, 112*d* to form four separate groups of arranged articles (not shown per se). Beneficially, in some arrangements, an apparatus 80 disclosed herein, automatically breaks the frangible connections 22, 24 between the top engaging clips 112*a*, 112*b*, 112*c*, 112*d* of the set of frangibly adjoined top engaging clips 112*a*, 112*b*, 112*c*, 112*d* such that the apparatus applies a single blank 110 to a grouped arrangement of articles 88 and forms four smaller groups of articles each joined by a top engaging clip 112*a*, 112*b*, 112*c*, 112*d*.

In order to aid the understanding of the applicator plates 10, apparatus 80 and methods which are the subject of the present application, the set 110 of frangibly adjoined top engaging clips 112*a*, 112*b*, 112*c*, 112*d* will be further described with reference to FIG. 3.

In the embodiments detailed herein, the terms "clip", "carton" and "carrier" refer, for the non-limiting purpose of illustrating the various features of the invention, to a container for engaging and grouping articles, such as primary product containers. It is contemplated that the teachings of the invention can be applied to various product containers, which may or may not be tapered and/or cylindrical. Exemplary containers include bottles (for example metallic, glass or plastics bottles), cans (for example aluminium cans), tins, pouches, packets and the like.

The blank 110 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The packaging structures or cartons described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the illustrated embodiment, the blank 110 is configured to form a set of four clips 112*a*, 122*b*, 112*c*, 112*d* for grouping, coupling or otherwise linking together an exemplary arrangement of exemplary articles 'C'. In the embodiment illustrated in FIG. 3, each of the four clips 112*a*, 122*b*, 112*c*, 112*d* holds together, in a grouped arrangement, six articles arranged in three rows of two articles each. The articles 'C' are beverage cans having a rim or chimed upper edge. Accordingly, the blank 110 is configured to be formed over a large grouped arrangement of articles 88. In the illustrated embodiment, the arrangement is a 6×4 matrix or array; in the illustrated embodiment four columns and six rows of articles are provided for a grouped arrangement 88 of twenty-four cans 'C'. In this illustrated embodiment, the blank 110 may employ four clips 112*a*, 112*b*, 112*c*, 112*d* in a 3×2 matrix or array, each being frangibly connected to at least two other blanks 112*b*, 112*c*, 112*d*, 112*a* by means of frangible connections 22, 24 and separating apertures A9. Alternatively, the blank 110 can be configured to form a carrier for packaging other types, number and size of articles and/or for packaging articles in a different arrangement or configuration to that shown herein.

Referring to FIG. 3, the blank 110 comprises four top engaging clips 112*a*, 112*b*, 112*c*, 112*d*, each having a main panel for forming a top wall or engaging panel of the clip 112*a*, 112*b*, 112*c*, 112*d*.

Each main panel includes at least one article retention structure R1, R2, R3, R4, R5, R6. In the embodiment of FIG. 3 each main panel comprises a plurality of article retention structures R1, R2, R3, R4, R5, R6, specifically six article retention structures R1, R2, R3, R4, R5, R6 arranged in 2×3 matrix or array.

Each of the article retention structures R1, R2, R3, R4, R5, R6 is substantially similar in construction and only one article retention structure will therefore be described in detail. It being understood that in other embodiments, the blank 110 may comprise more than one article retention structure having a different size, format, configuration and/or structure compared to that shown and the applicator plate may be adapted accordingly to accommodate such clips.

Each article retention structure comprises an aperture A1. A plurality of article engaging tabs ti, tii, tiii, tiv, tv, tvi, tvii, tviii, tix, tx (ti-tx) are arranged about the periphery of the aperture A1. Each tab ti-tx is hinged to the main panel 12 by a fold line 17. Each tab ti-tx is spaced apart from its adjacent neighbours by a cutaway or recess 18. In this way each tab ti-tx comprises a first side edge 19 and a second side edge 21. Each tab ti-tx comprises a free end edge 23 opposing the hinged end edge 17. The free end edges 23 form engaging edges for retaining an article 'C', or at least a portion thereof, within the aperture A1. In other embodiments, the number, size, format, and/or arrangement of tabs may differ from that described here. For example, the aperture A1 may not have a uniform configuration; may not be symmetrical; may have a different number of tabs; may include one or more tabs of a different size; and/or may have an irregular shape. The applicator plate may be adapted accordingly to accommodate such clips.

Each of the recesses 18 comprises a curvilinear portion 20. In the illustrated embodiment the recesses 18 comprise a rounded end. That is to say the curvilinear portion 20 can be defined by a portion of the circumference of a notional circle. A portion of the recess 18 may be defined by a segment of a circle. A further portion of the recess 18 may be defined by a trapezoid; the trapezoid may be an isosceles trapezoid. The trapezoid has convergent side edges 19, 21. Each tab ti-tx may be hinged to the main panel 12 by a straight fold line 17 which straight fold line 17 is in tangential contact, or intersects, with the rounded end 20 of the adjacent recess 18.

The curvilinear portion 20 or rounded end of the cutaway 18 may reduce the likelihood of tears propagating in the main panel 12 from the cutaway 18.

In the illustrated embodiment each article retention structure R1 comprises ten tabs ti-tx arranged about the periphery of the aperture A1. The article retention structure R1 defines a notional circle. The circle C1 is defined by the vertices of a first polygon defined by the fold lines 17 of the tabs ti-tx. In the illustrated embodiment the first polygon is a decagon, or ten sided polygon; in other embodiments, other polygons having more or less sides may be employed. Each of the sides 17 of the first polygon are of equal length.

The free end edges 23 of the tabs ti-tx define a second polygon. The tabs ti-tx have a height defined between the free end edge 23 and the hinged edge 17. In the illustrated embodiment the first polygon is a decagon, or ten sided polygon; in other embodiments other polygons having more or less sides may be employed. The second polygon comprises the same number of sides as the first polygon. Each of the sides of the second polygon is of equal length. In other embodiments, the sides of the first and/or second polygon may not each have an equal length and the sides may have one or more lengths; and/or the number of sides may differ from that illustrated.

The main panels 112*a*, 112*b*, 112*c*, 112*d* each comprise a matrix or array of article retention apertures R1-R6, in a Y×Z arrangement, where Y indicates the number of rows of articles 'C' and Z indicates the number of columns of articles 'C'.

In the embodiment illustrated in FIG. 3 the articles 'C' are arranged in a 3×2 matrix. The width of the main panel 12 may be equal to twice the maximum width of the article 'C'. The length L of the main panel 12 may be equal to thrice the maximum width of the article 'C'.

The diameter of the notional circle may be less than the maximum diameter of an article 'C' and greater than the (smaller) diameter of the chime, cap or flange of the article 'C'.

The main panel 12 may optionally comprise a handle structure. The handle structure may comprise a first handle aperture A7 and a second handle aperture A8. The first handle aperture A7 is struck from the main panel 12 and is located in a region disposed centrally between four article retention structures R1, R2, R3, R4. The second handle aperture A8 is struck from the main panel 12 and is located in a region disposed centrally between four article retention structures R3, R4, R5, R6. The first handle aperture A7 may be defined in part by a cushioning tab hinged to the main panel 112*a*, 112*b*, 112*c*, 112*d* by a fold line. The second handle aperture A8 may be of similar construction.

The main panel 112*a*, 112*b*, 112*c*, 112*d* may optionally comprise one or more pull tabs T1. The pull tabs T1 may be located substantially at the corners of the main panel 112*a*, 112*b*, 112*c*, 112*d*. The pull tabs T1 may be substantially triangular in shape. The pull tabs T1 may be arranged to extend the main panel 12 beyond the footprint of the group of articles C1*a*, C2*a*, C1*b*, C2*b*, C1*c*, C2*c* being packaged; in this way a user may more readily disengage the carrier or clip 112*a*, 112*b*, 112*c*, 112*d* from a group of articles C1*a*, C2*a*, C1*b*, C2*b*, C1*c*, C2*c*.

The main panel 112*a*, 112*b*, 112*c*, 112*d* optionally includes at least a paperboard substrate and a tear resistant layer laminated together. It optionally includes an adhesive layer between the paperboard substrate and the tear resistant layer. The material of the paperboard substrate may be selected from any conventional paperboard, for example, ranging in weight upwardly from about 10 pt., preferably from about 11 pt. to about 14 pt An example of such a substrate is a 12-point SBS board or CNK board manufactured by WestRock Company. The paperboard substrate may be a bleached or unbleached board. The board may be coated on at least one side, optionally the side opposite the lamination, with a conventional coating selected for compatibility with the printing method and board composition.

The tear resistant layer may be disposed over the uncoated side of the paperboard substrate and may be formed of polymeric material and secured to the substrate. The tear resistant layer imparts toughness to the laminate structure. Suitable tear resistant materials may include, but not be limited to, tear resistant laminated sheet material, e.g., NATRALOCK®, which may include a layer of an n-axially oriented film, e.g. MYLAR®, which is a bi-axially oriented polyester, oriented nylon, cross-laminated polyolefin or high density polyolefin. The orientation and cross-laminated structure of these materials contribute to the tear resistant characteristic. Also, tear resistance may be attributed to the chemical nature of the tear resistant material such as extruded metallocene-catalyzed polyethylene (mPE).

Alternatively, the tear resistant layer may be a layer of linear low-density polyethylene (LLDPE). In embodiments where linear low-density polyethylene (LLDPE) or mPE is used, it is not necessary to incorporate an adhesive layer. Other suitable materials having a high level of tear resistance may also be used.

The adhesive layer may be formed of polyolefin material such as a low density polyethylene (LDPE). The adhesive layer may be placed between the substrate and the tear resistant layer to secure the tear resistant layer to the substrate.

Figure 4:
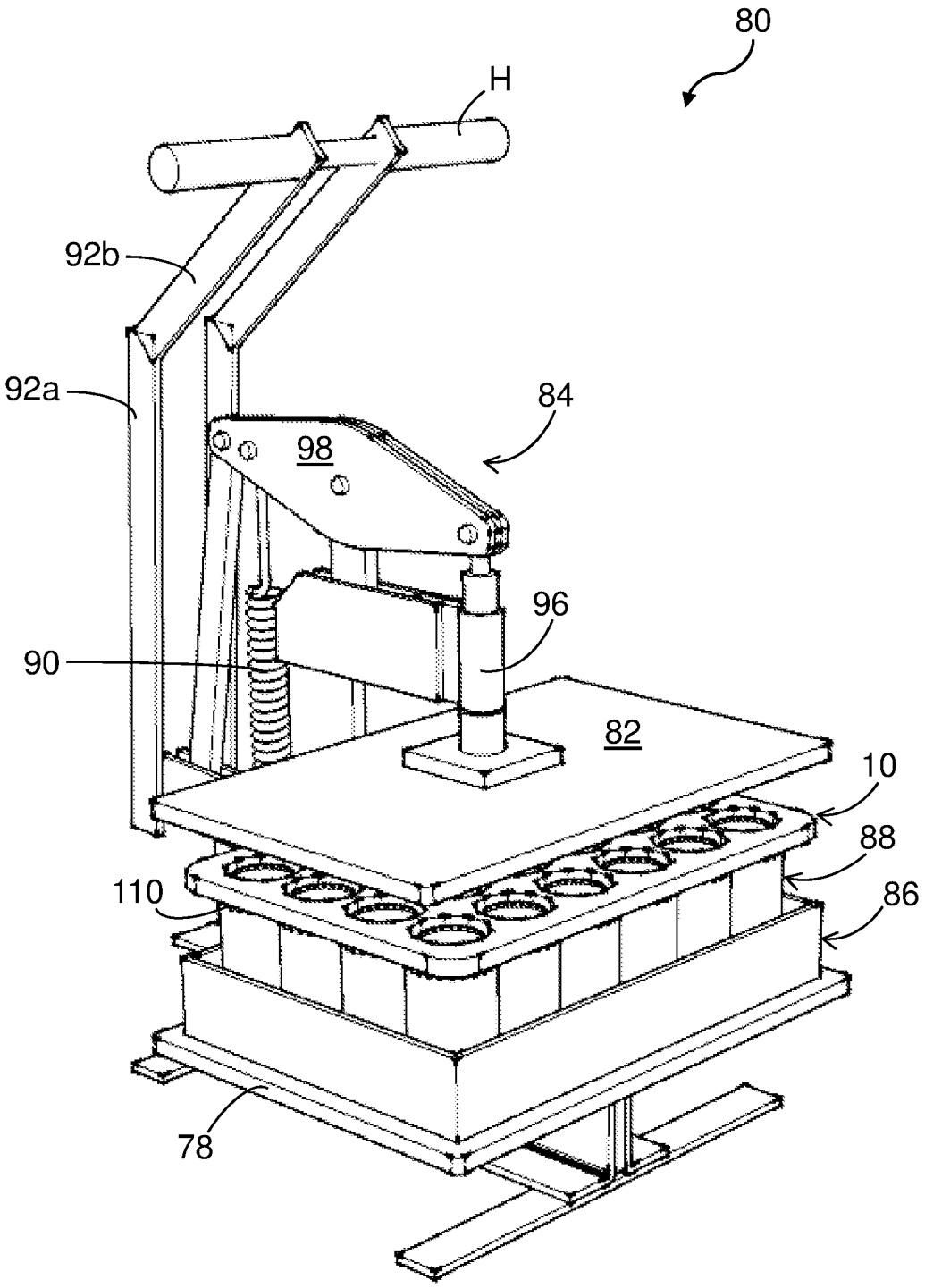
FIG. 4 is a perspective view from above of an apparatus for attaching a set of adjoined top engaging clips, such as that shown in FIG. 3, to a group of articles, the apparatus comprising the applicator plate of FIGS. 1 to 2B.
Figure 5:
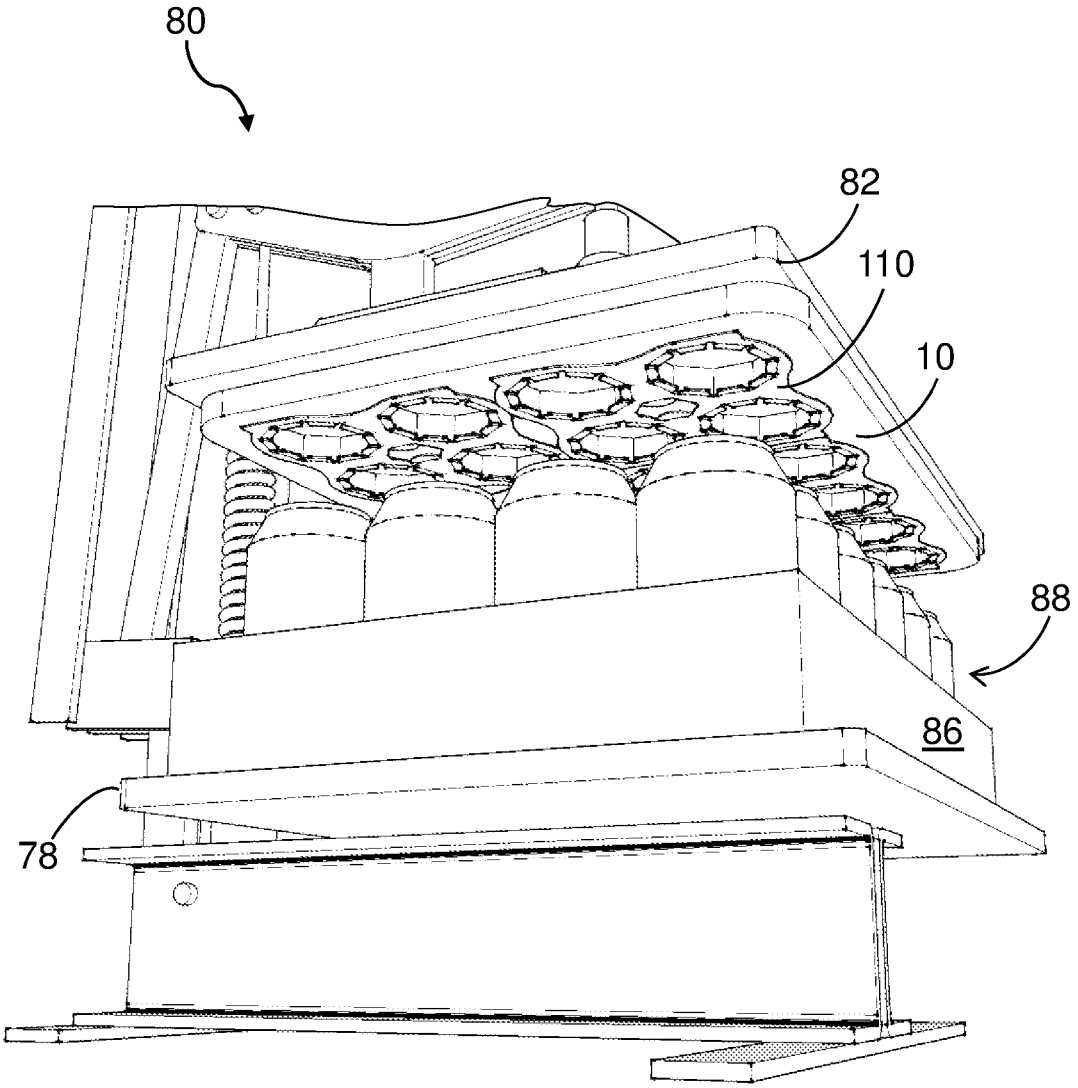
FIG. 5 is a perspective view from below of a portion of the apparatus of FIG. 4 showing the set of adjoined top engaging clips on a lower surface of the applicator plate and a grouped arrangement of cans ready to have the set of clips applied thereto for forming into four separate 2×3 groups of cans.

Turning now to the apparatus 80 and applicator plate 10 used therein for constructing the blank 110 into a carrier containing groups of articles, reference is made to FIG. 4. In FIG. 4 there is a perspective view of an apparatus 80 capable of accepting an input of primary products, such as, but not limited to, bottles or cans, hereinafter referred to as articles 'C'.

The apparatus 80 is for attaching a set of adjoined top engaging clips 110 to a group of articles 88, such as cans 'C'. The apparatus comprises an applicator plate 10 (see FIGS. 1, 2A and 2B) which is described in further detail below. The apparatus 80 is used in conjunction with a grouping component 86 (see FIGS. 5, 6B, 7B and 8) structured and arranged for receiving a group of articles 88 and for maintaining the group of articles 88 as an organized group. The grouping component 86 is optionally a tertiary packaging carton which may optionally be formed from corrugated board and which may be removed from the apparatus with the clipped together cans. Alternatively, the grouping component may be a tray that is used to collect individual cans 'C' leaving a canning line (not shown) and group them together into a set 88 of cans 'C'. The apparatus also comprises a reciprocating element 84 and a base plate 78. The reciprocating element 84 is optionally coupled to the applicator plate 10, is positioned relative to the base plate 78, and is operable to move the applicator plate 10 down towards the base plate 78 and up away from the base plate 78.

The applicator plate 10 is structured and arranged to locate and form the set of frangibly adjoined top engaging clips 110 onto a group of articles 88 positioned on, in or within the grouping component 86 and is structured and arranged to break the frangible connections 22, 24 between adjoined engaging clips 112*a*, 112*b*, 112*c*, 112*d* of the set in order to form a discrete number of clipped together groups of articles. In this illustrated arrangement four discrete groups of six articles, each clipped together in a 2×3 arrangement are formed.

As shown, in FIGS. 5, 6B, 7B and 8 the grouping component 86 comprises four sides, a base, and an open top. A grouped arrangement of articles 88 can be deposited on the base and retained by the four side walls. In other embodiments it is envisaged that the grouping component 86 may take a variety of structures, configurations and formals suitable for facilitating the placement of a group of articles 88 thereon and suitable for maintaining the articles 88 in an organized group. In this way, when the apparatus 80 is operational and the applicator plate 10 is lowered down onto the tops of the articles 'C' and is located thereon, the articles 'C' cannot and do not move, and their relative locations are not disturbed, thus enabling the applicator plate 10 to locate and/or form the set of frangibly connected top gripping clips 110.

The reciprocating element 84 comprises a handle 'H', a lever arm 98 and a coil spring 90 coupled together such that movement of the handle 'H' causes the spring 90 to contract or extend which causes the top plate 82 and applicator plate 10 (coupled thereto) to be lifted up away from or moved down towards the base plate 78. The handle 'H' may be coupled by via one or more handle arms 92*a*, 92*b* to a lower end of the coil spring 90. An upper end of the coil spring 90 may be coupled to a first end of the lever arm 98. The lever arm 98 may pivot about a central fulcrum. A second end of the lever arm 98 may be coupled to a rod 96 and the rod 96 may be coupled to a top plate 82. The applicator plate 10 may be releasably attachable to the apparatus 80. Optionally, the applicator plate 10 may be releasably attachable to the top plate 82. In this way when a clip or set of frangibly connected clips having a different arrangement of apertures is used to group a number of articles in an arrangement differing from that shown in FIG. 3, such that an applicator plate having a matching configuration or similarly shaped apertures is required, the new applicator plate can be substituted for the original applicator plate 10 without having to replace the entire apparatus 80. The applicator plate 10 may also be referred to as an "applicator mould" since it is a component that is structured and arranged to mould and form the top gripping clip onto the group of articles 88.

The apparatus 80 may comprise a drive means for moving the reciprocating element 82 up and down, thus avoiding manual articulation using a handle (which would not be required). Such an arrangement may incorporate a motor, a piston and/or other suitable electro mechanical components to facilitate automated lifting and lowering of the applicator plate 10. However, in the present operation, the apparatus is manually operated.

Figure 1:
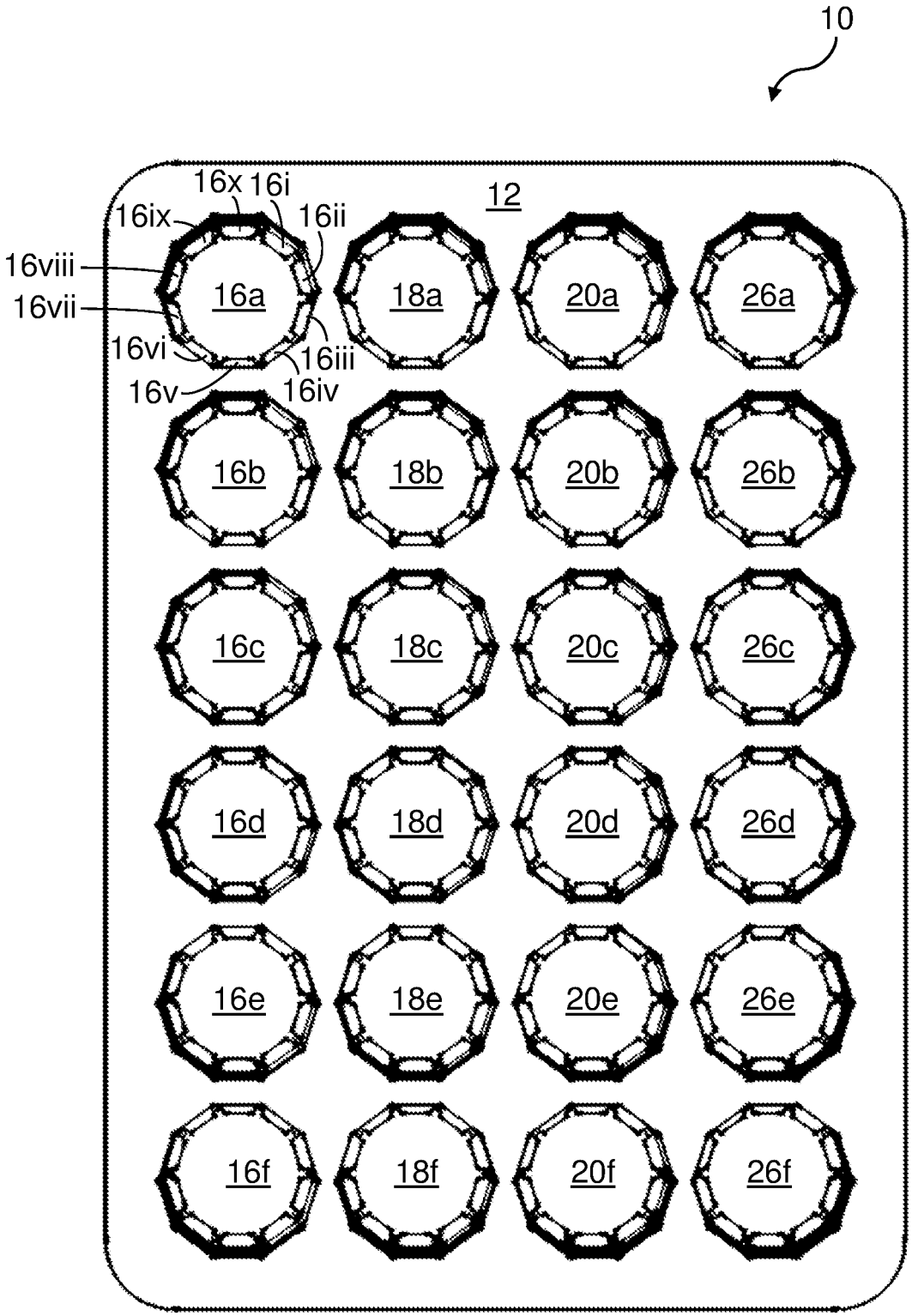
FIG. 1 is a plan view of an upper surface of an applicator plate for use in an apparatus for attaching a set of adjoined top engaging clips to a group of articles, such as cans, according to a first embodiment of the invention.
Figure 2A:
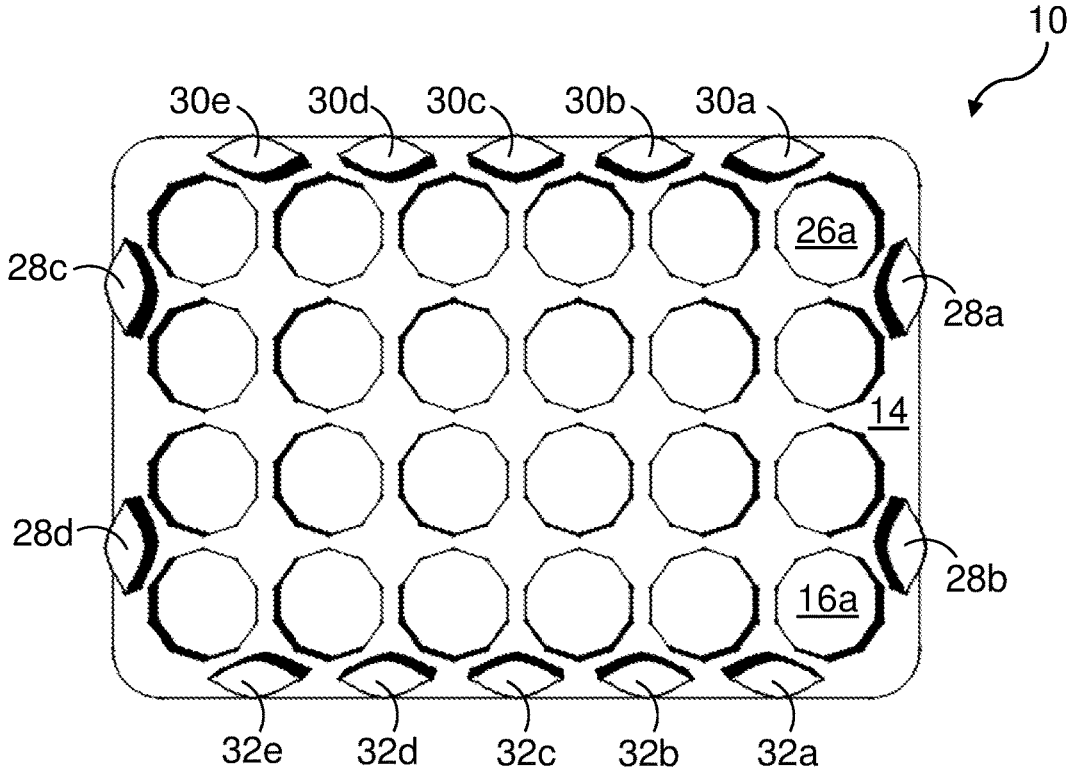
FIG. 2A is a plan view of a lower surface of the applicator plate of FIG. 1.
Figure 2B:
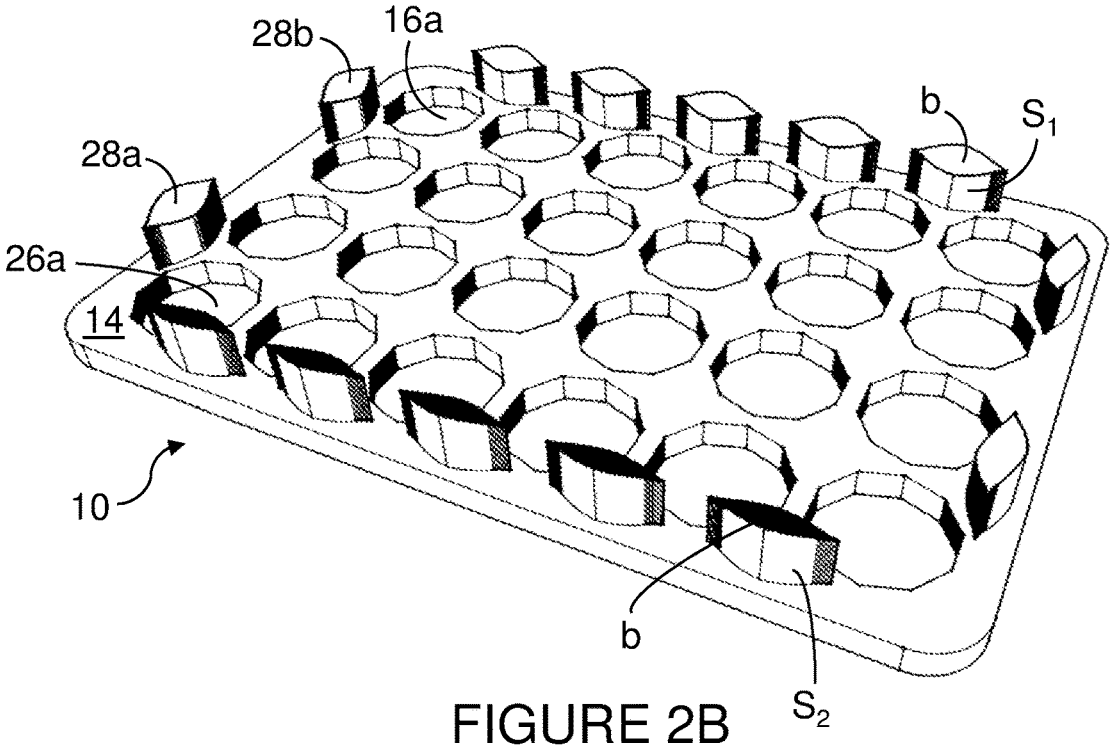
FIG. 2B is a perspective view of the lower surface and side edge of the applicator plate of FIGS. 1 and 2.

The applicator plate 10 which may optionally be utilized in the apparatus 80 for attaching a set of frangibly adjoined top engaging clips 110 to a group of articles 88 is best shown in FIGS. 1, 2A and 2B. The applicator plate 10 has a generally planar body and comprises a plurality of apertures 16*a* to 24*f* formed within the body. The plurality of apertures 16*a*-24*f* is optionally arranged in a matrix matching the arrangement of apertures A1 provided in the set of top engaging clips 110. Accordingly, in this embodiment and for use with a top engaging clip 110 such as that shown in FIGS. 3 and 4, the applicator plate 10 comprises a four column by six row arrangement of apertures 16*a*, 16*b*, 16*c*, 16*d*, 16*e*, 16*f*, 18*a*, 18*b*, 18*c*, 18*d*, 18*e*, 18*f*, 20*a*, 20*b*, 20*c*, 20*d*, 20*e*, 20*f* and 26*a*, 26*b*, 26*c*, 26*d*, 26*e*, 26*f* (herein referred to collectively as 16*a*-26*f*). In other embodiments or arrangements, the applicator plate 10 may have a different number and/or different arrangement of articles.

Each aperture (16*a*-26*f*) within the applicator plate 10 is formed entirely through the depth of the applicator plate 10. Each aperture 16*a*-26*f* comprises a series of internal walls arranged such that each aperture 16*a*-26*f* has shape, size, configuration and relative location that cooperates with the arrangement of article retention structure R1, R2, R3, R4, R5, R6. Accordingly, in this optional illustrated arrangement, each aperture 16*a*-26*f* has a polygonal cross-sectional shape. Optionally, each aperture 16*a*-26*f* has ten evenly sized and evenly angled internal walls 16*i*-16*x* arranged such that each aperture 16*a*-26*f* has a decagon shape.

An upper surface 12 of the generally planar body of the applicator plate 10 is optionally flat and optionally smooth. In other arrangements the upper surface 12 may comprise attachment means for coupling the applicator plate 10 to the top plate 82 of the reciprocating component 84. In some arrangements the applicator plate 10 also serves as the top plate 82 and is directly coupled to the reciprocating component 84.

The applicator plate 10 may additionally comprise at least one alignment peg (referred to herein simply as "peg") 28*a*, 28*b*, 28*c*, 28*d*, 30*a*, 30*b*, 30*c*, 30*d*, 30*e*, 32*a*, 32*b*, 32*c*, 32*d*, 32*e*, depending from the lower surface 14 of said generally planar body. This is best seen in FIGS. 2A and 2B. Optionally, the at least one peg 28*a*-32*e* has a flat base 'b' and two side walls S1, S2. The at least one peg 28*a*-32*e* is symmetrical. The two side walls S1, S2 meet at a first end of the at least one peg 28*a*-32*e*. The two side walls S1, S2 meet at a second end of the at least one peg 28*a*-32*e* and between the first and second ends the two side walls S1, S2 each curve outwardly away from the first and second ends. Optionally, the at least one peg 28*a*-32*e* has a substantially leaf-shaped cross-section.

As described above the plurality of apertures 16*a*-26*f* are arranged in a matrix of rows and columns. Four columns of apertures 16, 18, 20, 26 each comprise six rows of apertures a, b, c, d, e, f each. Apertures 16*a*, 18*a*, 20*a*, 26*a* define a first end of the matrix of apertures 16*a*-26*f*; apertures 16*a*, 16*b*, 16*c*, 16*d*, 16*e*, 16*f* define a first side of the matrix of apertures 16*a*-26*f*; apertures 16*f*, 18*f*, 20*f*, 26*f*; define a second end of the matrix of apertures 16*a*-26*f*; and apertures 32*a*, 32*b*, 32*c*, 32*d*, 32*e*, 32*f* define a second side of the matrix of apertures 16*a*-26*f*.

The at least one peg 28*a*-32*e* hangs down or depends from the lower surface 14. The pegs 28*a*-32*e* may be positioned at a location along the first or second end of the matrix of apertures 16*a*-26*f*. The pegs 28*a*-32*e* may be positioned at a location along the first or second side of the matrix of apertures 16*a*-26*f*. Optionally, each peg 28*a*-32*e* is positioned adjacent to two apertures 16*a*-26*f* of the matrix. Each peg 28*a*-32*e* may be shaped to fit in the gap between the lower edges of two internal walls of one aperture and the lower edges of two internal walls of another adjacent aperture. For example, a peg 28*b* located along a first end of the matrix of apertures 16*a*-26*f*, fits between the lower edges of internal walls 16*i* an 16*ii* of aperture 16*a*; and the lower edges of internal walls 18*ix* and 18*viii* of aperture 18*a* (see FIG. 2A).

In the illustrated arrangement each peg 28*a*-32*e* comprises fourteen pegs 28*a*-32*e*. The arrangement of fourteen pegs 28-32*e* comprises two pegs 28*a*, 28*b*; 28*c*, 28*d* at each end of the four columns of apertures and five pegs 30*a*, 30*b*, 30*c*, 30*d*, 30*e*; 32*a*, 32*b*, 32*c*, 32*d*, 32*e* at each of the first and second sides of the matrix of apertures 16*a*-26*f*. The applicator plate may be constructed from a single member or may be made from one or more components and further optionally may be formed from multiple cooperative components and may have, for example, a modular structure.

Figure 6A:
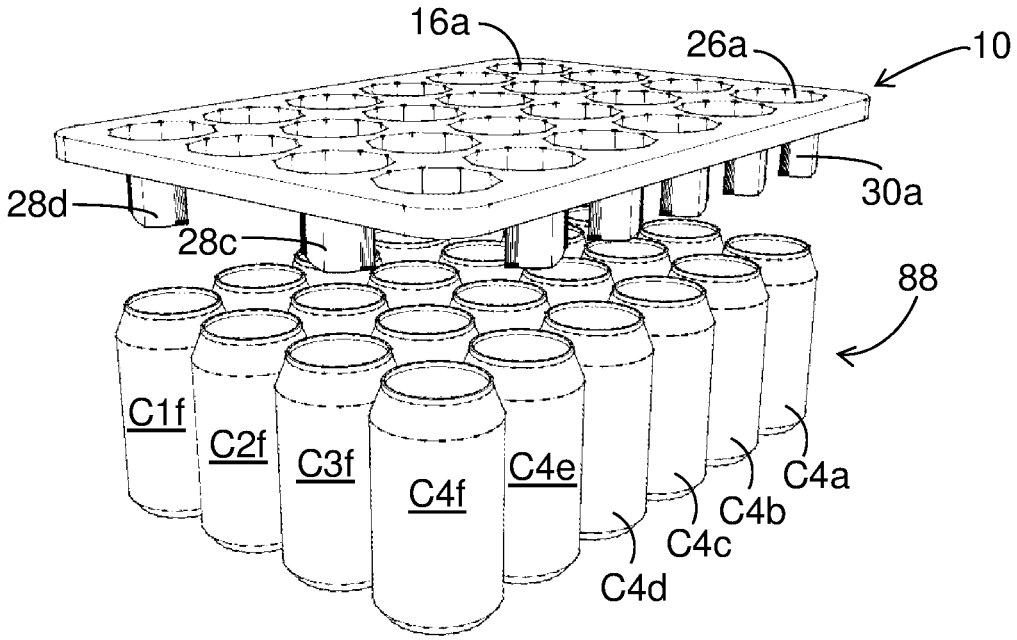
FIG. 6A is a perspective view from above of the applicator plate and a grouped arrangement of articles, wherein the applicator plate is aligned above the group in readiness for applying the set of adjoined top engaging clips.
Figure 6B:
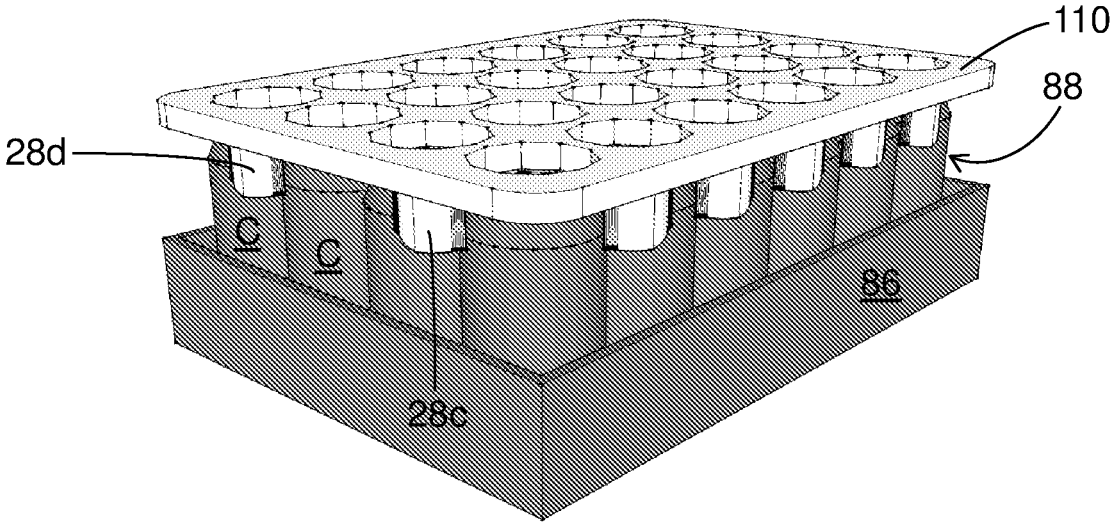
FIG. 6B is a perspective view from above of the applicator plate disposed on top of the grouped arrangement of articles of FIG. 6, showing that the applicator plate is applying the set of adjoined top engaging clips.
Figure 7A:
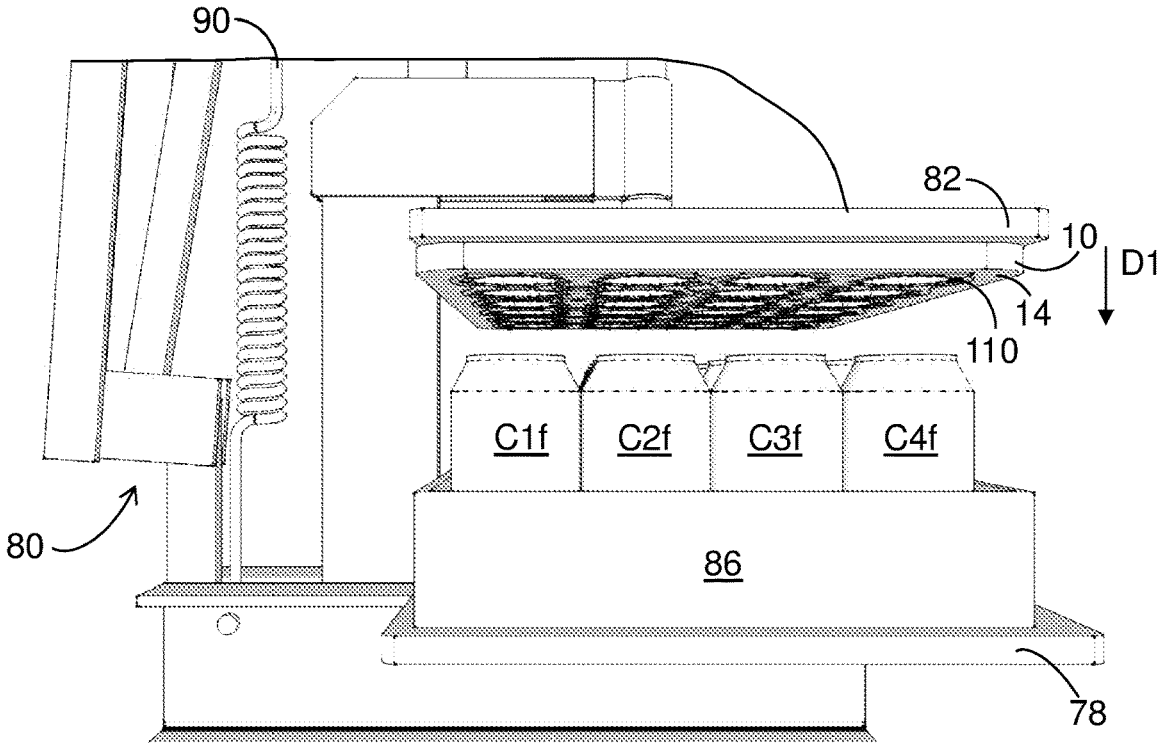
FIG. 7A is a perspective view from the side of the apparatus of FIGS. 4 and 5 showing the applicator plate and a grouped arrangement of articles, wherein the applicator plate is aligned above the group in readiness for applying the set of adjoined top engaging clips.
Figure 7B:
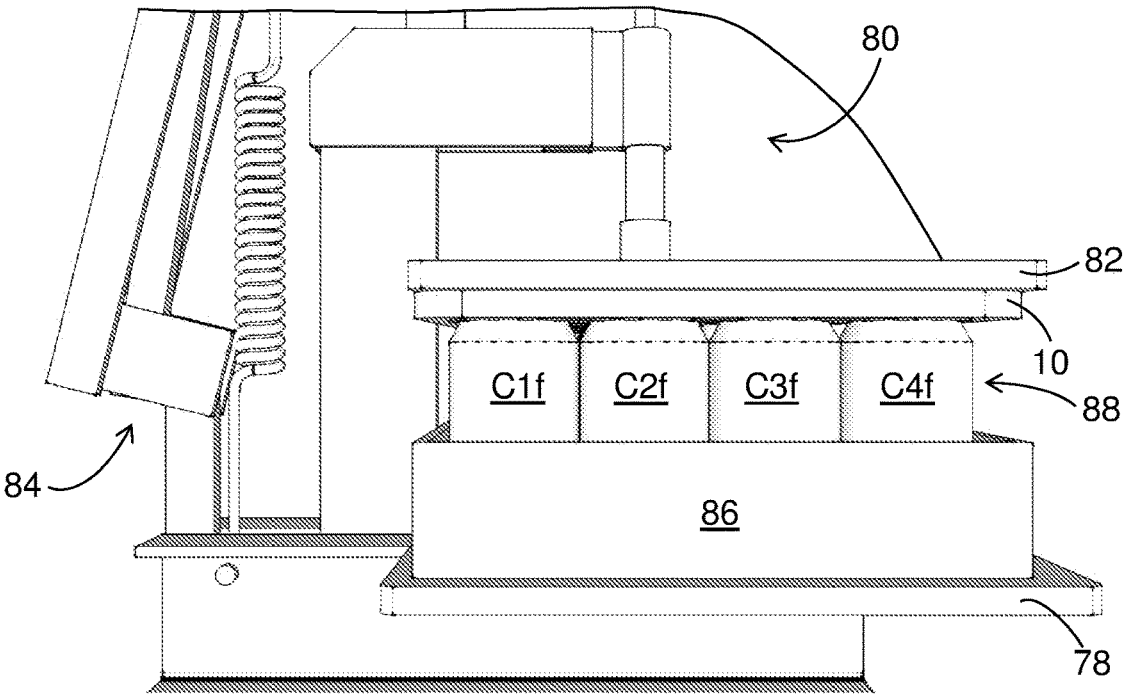
FIG. 7B is a perspective view from the side of the apparatus of FIGS. 4 and 5 showing that the applicator plate is applying the set of adjoined top engaging clips.
Figure 8:
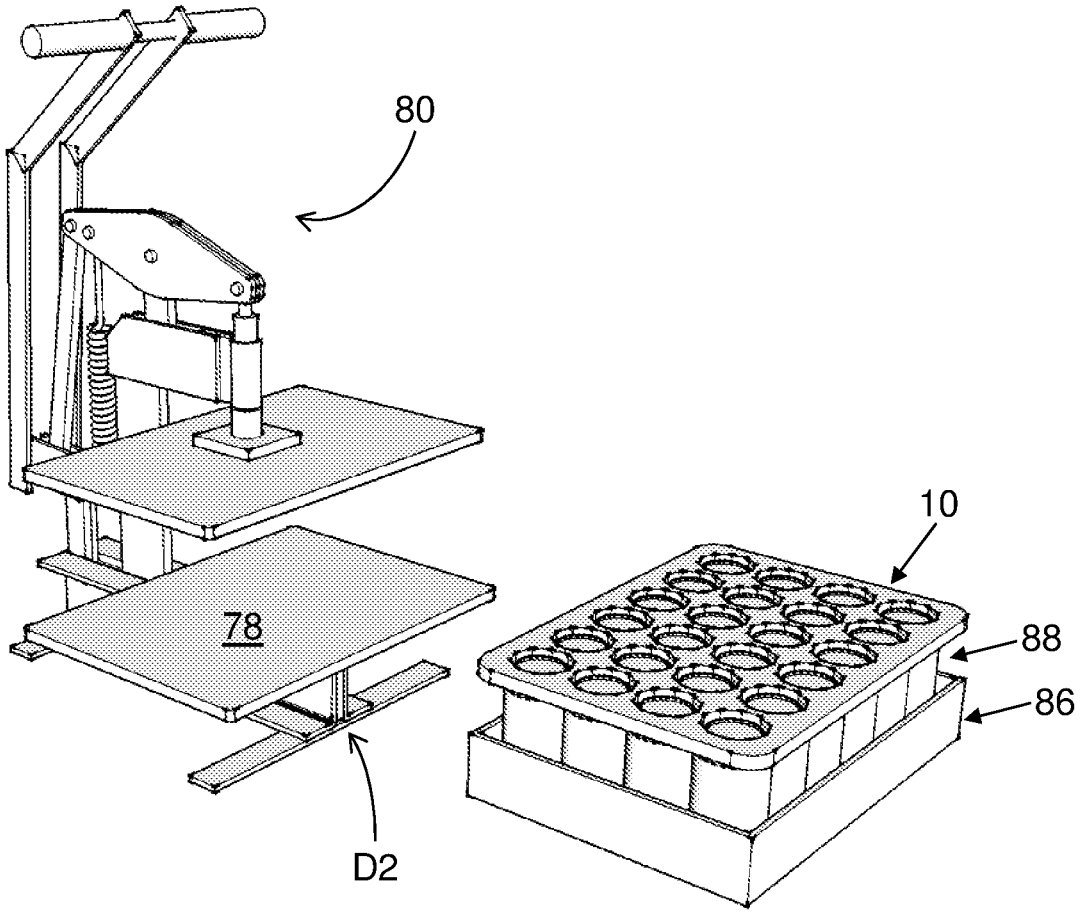
FIG. 8 is a perspective view from above of the apparatus of FIGS. 4, 5, 7A and 7B, showing a grouping component for receiving the group of cans and for maintaining the group of cans as an organised group removed from the remainder of the apparatus.
Figure 9:
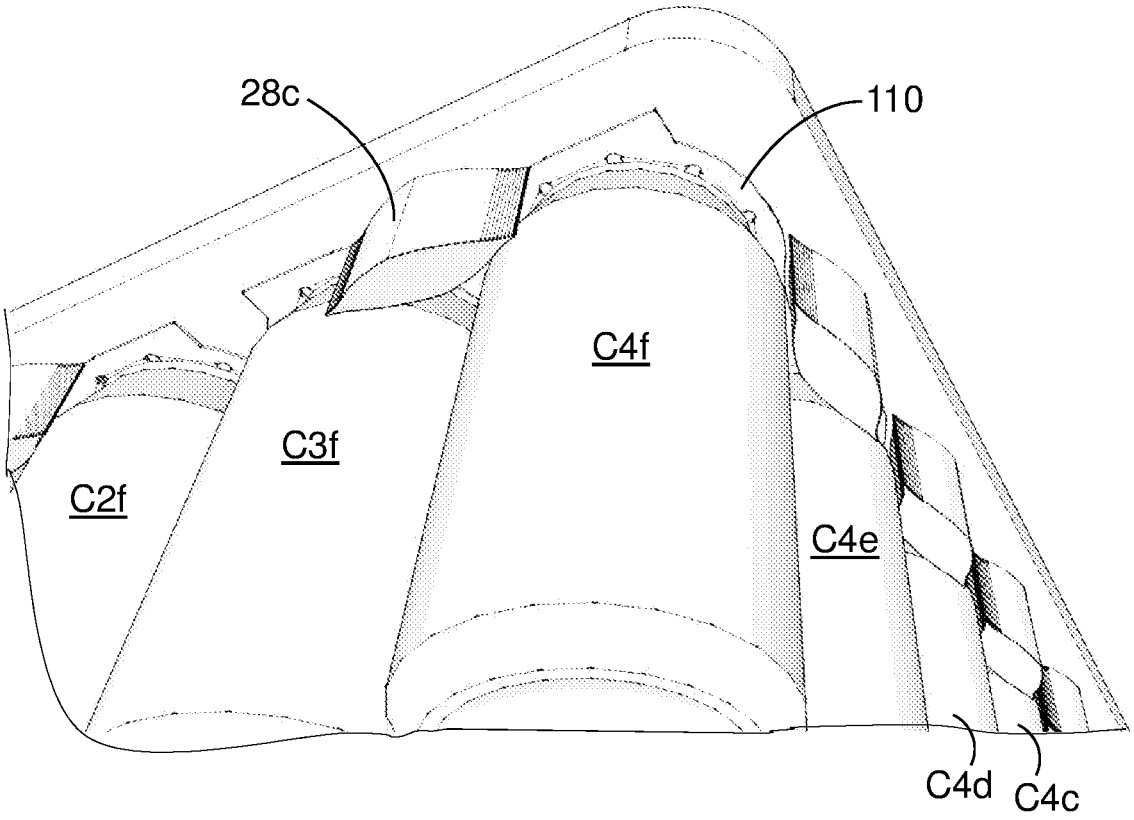
FIG. 9 is a perspective view from below of a portion of a group of cans showing the applicator plate aligned with and disposed on top of the article group and showing the set of adjoined clips in the process of being applied to the group.

The shape, size and location of the alignment pegs 28*a*-32*e* enables the pegs to fit closely between two adjacent articles of the group of articles 88 (see FIGS. 6B and 9). In this way as the applicator plate 10 is lowered towards the group of articles 88, the pegs 28*a*-32*e*, locate in gaps between two adjacent articles (see for example peg 28*c* between articles C3*f* and C4*f* in FIG. 9). Together the pegs 28*a*-32*e* arranged around the perimeter of the group or articles 88 ensure that as well as being held by the grouping component 86 at a bottom end, the articles 88 are held in a correct position and carefully aligned with the incoming applicator plate 10.

Turning to the construction of the top engaging clips and grouped articles from the blank 110, the following method may be employed. Firstly, a group of articles 88 is received and optionally maintained as an organized group of articles. This may be achieved with the assistance of the grouping component 86. An applicator plate 10, as described above may be provided and may be associated with the set of frangibly adjoined top engaging clips 110 and top plate 82. More specifically, the set of frangibly adjoined top engaging clips 110 may be associated with a lower surface 14 of the applicator plate 10. The set of frangibly adjoined top engaging clips 110 may be associated with a lower surface 14 of the applicator plate 10 by means of vacuum suction, temporary mechanical attachment or by other suitable means. Then the applicator plate 10 and associated set of frangibly adjoined top engaging clips 110 are moved down towards the group of articles 88 by actuation of the reciprocating element 84 of the apparatus 80; then the arrangement of pegs 28*a*-32*e* are located around the articles to ensure proper alignment between the applicator plate 10, clip 110 and group 88; and then the set of frangibly adjoined top engaging clips 110 are located, pressed onto and formed onto the group of articles 88. In pressing and forming the top engaging clips 110 onto the group of articles, the frangible connection 24 between adjoined top engaging clips 112*a*, 112*b*, 112*c*, 112*d* is broken, thus automatically forming a discrete number of clipped together groups of articles. Alternatively, the set of frangibly adjoined top engaging clips 110 may be located directly on top of the grouped arrangement of articles; and a lower surface 14 of the applicator plate 10 may become associated with the set of frangibly adjoined top engaging clips 110 only once the applicator plate 10 has been moved down onto the group of articles 88.

The apparatus facilitates the relative movement of the blank 110, applicator plate and article group in an aligned manner. Optionally, the blank 110 and applicator plate 10 are lowered with respect to the group of articles 88 such that each of the plurality of apertures 16*a*-26*f* of the applicator plate 10 and such that each article retention structure R1, R2, R3, R4, R5, R6 of each top engaging clip 112*a*, 112*b*, 112*c*, 112*d* of the blank 110 is aligned with a respective article 'C' in the group of articles 88. Furthermore, the applicator plate 10 is aligned with the set of frangibly adjoined top engaging clips 110 such that an internal wall 16*i*-16*x* of each polygonal aperture 16*a*-26*f* is aligned with a fold line 17 of a corresponding article retention structure R1, R2, R3, R4, R5, R6 of a top engaging clip 112*a*, 112*b*, 112*c*.

By relative movement of the article group 88 and applicator plate 10 and blank 110, upper portions of each article 'C' passes through the main panel of each top engaging clip 112*a*, 112*b*, 112*c*, 112*d*. As the internal walls 16*i*-16*x* of each aperture 16*a*-26*f* of the applicator plate 10 move down against the article tops 'C', the tabs ti-tx of each of the article retention structures R1, R2, R3, R4, R5, R6 are folded out of the plane of the main panel and engage beneath the chime or flange of an article 'C'. The depth of the applicator plate 10 is sufficient to ensure that the tabs ti-tx of each of the article retention structures R1, R2, R3, R4, R5, R6 are folded and fully engage with each article 'C'. In this way the tabs ti-tx grip or hold the articles 'C' and prevent or inhibit the articles 'C' from unintentionally separating from the main panel of each top engaging clip 112*a*, 112*b*, 112*c*, 112*d*. It will be recognized that whereas the apparatus 80 provides a moving top plate 82, that holds and moves the applicator plate 10 and blank 110 down towards the article group 88, in other arrangements, the base plate 78 housing the article group 88 may move upwardly towards a top plate 82 holding the applicator plate 10 and blank 110. In yet further non-illustrated arrangements, both the top plate 82 and base plate 78 may move towards each other.

Another optional feature of the top engaging clips 112*a*, 112*b*, 112*c*, 112*d* is that the main panels are each defined by a perimeter to which no other part of the top engaging clip 112*a*, 112*b*, 112*c*, 112*d* is connected. That is to say the top engaging clip 112*a*, 112*b*, 112*c*, 112*d* is free of connection to other panels for example, but not limited to, side or end wall panels which in other carriers extend about the sides of the article group. The perimeter of the main panel 12 is therefore defined in its entirety by free, cut or unhinged edges. The perimeter of the main panel may be folded at an angle relative to the rest of the main panel, by virtue of the folding of the polygonal arrangement of tabs ti-tx of the article retention structures R1, R2, R3, R4, R5, R6 and their engagement beneath the chime or flange of an article 'C'. Accordingly, the frangible connections 22, 24 are broken and the set of frangibly adjoined top engaging clips 110 is automatically broken into four separate top engaging clips 112*a*, 112*b*, 112*c*, 112*d* thus forming four separate groups of articles.

Figure 10:
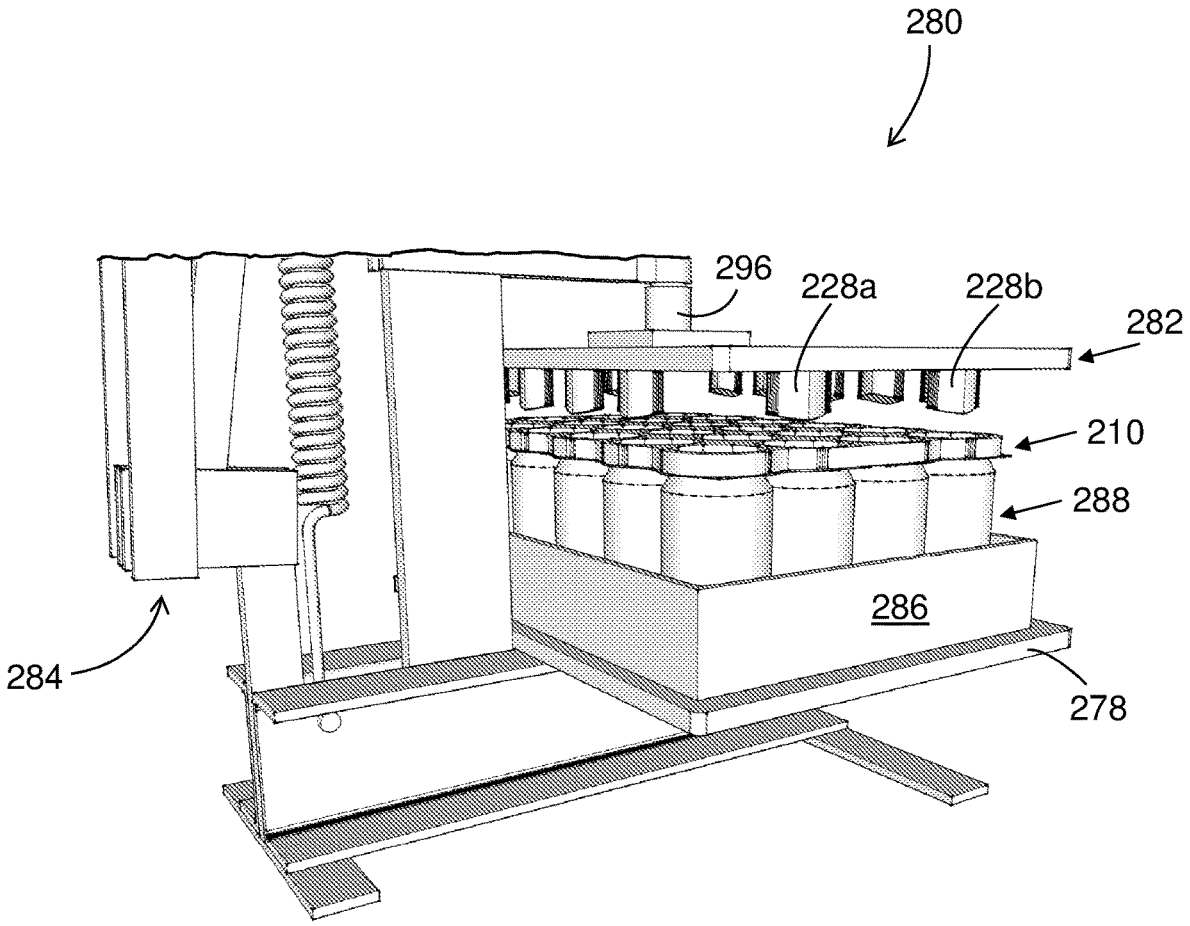
FIG. 10 is a perspective view from the side of an apparatus according to various embodiments showing an applicator plate and a grouped arrangement of articles, wherein the applicator plate is aligned above the group in readiness for attaching the set of adjoined top engaging clips to the article group.

Referring now to FIG. 10, there is shown an alternative embodiment of the present invention. In the second illustrated embodiment, like numerals have, where possible, been used to denote like parts, albeit with the addition of the prefix "200" to indicate that these features belong to the second embodiment. The alternative embodiment shares many common features with the first embodiment and therefore only the differences from the embodiment illustrated in FIGS. 1 to 9 will be described in any greater detail.

In FIG. 10 the apparatus 280 again comprises top plate 282 that moves downwardly towards a group of articles 288 held within a grouping component 286 on a base plate 278. However, in this arrangement, the top plate 282 comprises a series of pegs 228*a*-232*e* and the applicator plate 210 comprises a series of recesses or apertures through which the series of pegs 228*a*-232*e* may pass. In this way, as the top plate 282 is lowered towards the article group 288, the pegs 228*a*-232*e* ensure both correct positioning and retain the position of the group of articles 88, and the applicator plate 210. The pegs may be removable to accommodate different articles, different article group sizes and/or different article group configurations.

It can be appreciated that various changes may be made within the scope of the present invention, for example, the size and shape of the panels and apertures may be adjusted to accommodate articles of differing size or shape. In other embodiments of the invention it is envisaged that the set of frangibly adjoined clips may be replaced by a single clip for a single group of articles.

It will be recognized that as used herein, directional references such as "top", "bottom", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. A fold line is typically a scored line, an embossed line, or a debossed line. Any reference to hinged connection or fold line should not be construed as necessarily referring to a single fold line only; indeed, it is envisaged that hinged connection can be formed from any one or more of the following, a short slit, a frangible line or a fold line without departing from the scope of the invention.

As used herein, the term "severance line" refers to all manner of lines that facilitate separating portions of the substrate from one another or that indicate optimal separation locations. Severance lines may be frangible or otherwise weakened lines, tear lines, cut lines, or slits.

It should be understood that hinged connection, severance lines and fold lines can each include elements that are formed in the substrate of the blank including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The invention claimed is:

1. A method of attaching at least one top engaging clip to a group of articles, the method comprising:

(i) receiving a group of articles and maintaining the group of articles as an organized group;

(ii) providing an applicator plate comprising:

a generally planar body;

a plurality of apertures formed through the body, corresponding to a plurality of articles, respectively, to which the at least one top engaging clip is to be applied; and at least one peg depending from a lower surface of said generally planar body and disposed at a perimeter portion of said generally planar body, wherein the generally planar body, the plurality of apertures, and the at least one peg serve together to apply the at least one top engaging clip to the plurality of articles; and (iii) locating and forming the at least one top engaging clip onto the group of articles thereby forming one or more clipped together groups of articles.

2. A method according to claim 1 wherein the one or more top engaging clips comprises a set of frangibly adjoined top engaging clips and the step of locating and forming the set of frangibly adjoined top engaging clips breaks, automatically and without mechanical intervention of a cutting means, the frangible connection between adjoined top engaging clips of the set and thereby forms a discrete number of clipped together groups of articles.

3. A method according to claim 1 further comprising:

(a) associating the set of frangibly adjoined top engaging clips with a lower surface of the applicator plate; and (b) moving the applicator plate and set of frangibly adjoined top engaging clips down towards the group of articles.

4. An apparatus for attaching at least one top engaging article carrier group of articles, the apparatus comprising:

an applicator plate configured to apply at least one top engaging article carrier to a group of articles, the applicator plate comprising:

a generally planar body;

a plurality of apertures formed through the body, corresponding to a plurality of articles respectively, to which the at least one top engaging article carrier is to be applied; and at least one peg depending from a lower surface of said generally planar body and disposed at a perimeter portion of said generally planar body, wherein the generally planar body the plurality of apertures, and the at least one serve together to apply the at least one top engaging article carrier to the plurality of articles;

a base plate for receiving the group of articles;

a reciprocating element coupled to the applicator plate and/or base plate and being operable to provide relative movement of the applicator plate and base plate toward one another and away from one another; and a top plate coupled to the reciprocating element.

5. An apparatus according to claim 4 wherein the reciprocating element is operable to move the top plate towards the base plate.

6. An apparatus according to claim 5 wherein the applicator plate is associated with the top plate and moves towards the base plate with the top plate.

7. An apparatus according to claim 6 wherein the applicator plate is structured and arranged to locate and form the set of frangibly adjoined top engaging clips onto a group of articles positioned on the base plate and is structured and arranged to break the frangible connection between adjoined engaging clips of the set in order to form a discrete number of clipped together groups of articles.

8. An apparatus according to claim 6 wherein a grouping component is provided and is structured and arranged for receiving a group of articles and for maintaining the group of articles as an organized group.

9. An apparatus according to claim 8 wherein the grouping component comprises four sides, a base and an open top and wherein a group of articles can be deposited on said base and retained by the four side walls.

10. An apparatus according to claim 5 wherein the applicator plate is releasably attachable to the top plate.

11. An apparatus according to claim 5 wherein the top plate comprises at least one alignment peg.

12. An apparatus according to claim 4 wherein the reciprocating element comprises a handle, lever arm and coil spring coupled together such that depression of the handle causes the spring to contract which causes the applicator plate to be lifted up away from the base plate.

13. An apparatus according to claim 4 wherein the applicator plate is releasably attachable to the apparatus.

* * * * *